US011780536B2

(12) United States Patent
Zhang et al.

(10) Patent No.: US 11,780,536 B2
(45) Date of Patent: Oct. 10, 2023

(54) MARINE COMMUNICATION BUOY

(71) Applicants: Hainan Normal University, Haikou (CN); CETC Guohaixintong Technology (Hainan) Co., Ltd., Sansha (CN)

(72) Inventors: Kun Zhang, Haikou (CN); Shengrong Zhang, Sansha (CN); Yu Zhou, Haikou (CN); Chaoyang Wang, Sansha (CN); Haixia Long, Haikou (CN); Haizhuang Hong, Sansha (CN); Yupeng Zhu, Sansha (CN)

(73) Assignees: HAINAN NORMAL UNIVERSITY, Haikou (CN); CETC GUOHAIXINTONG TECHNOLOGY (HAINAN) CO., LTD, Sansha (CN)

( * ) Notice: Subject to any disclaimer, the term of this patent is extended or adjusted under 35 U.S.C. 154(b) by 0 days.

(21) Appl. No.: 17/888,802

(22) Filed: Aug. 16, 2022

(65) Prior Publication Data

US 2023/0046524 A1 Feb. 16, 2023

Related U.S. Application Data

(63) Continuation of application No. PCT/CN2022/074912, filed on Jan. 29, 2022.

(30) Foreign Application Priority Data

Aug. 12, 2021 (CN) ..... CN202110922810

(51) Int. Cl.
*B63B 22/00* (2006.01)
*B63B 45/00* (2006.01)

(52) U.S. Cl.
CPC ..... *B63B 22/00* (2013.01); *B63B 45/00* (2013.01); *B63B 2203/00* (2013.01)

(58) Field of Classification Search
CPC ..... B63B 22/00; B63B 45/00; B63B 2203/00; B63B 22/18
See application file for complete search history.

(56) References Cited

U.S. PATENT DOCUMENTS 2,346,325 A * 4/1944 Norris ..... B63B 51/04 340/331
3,811,662 A * 5/1974 Kaelin ..... B01F 23/23421 261/120

(Continued)

FOREIGN PATENT DOCUMENTS

CN 103883269 A 6/2014
CN 106828783 A 6/2017

(Continued)

OTHER PUBLICATIONS

WO-2023015854-A1: Zhang et al., "Marine Communication Buoy", Feb. 2023. (Year: 2023).*

(Continued)

*Primary Examiner* — John Fitzgerald
*Assistant Examiner* — Tania Courson
(74) *Attorney, Agent, or Firm* — WPAT, P.C.

(57) ABSTRACT

Disclosed is a marine communication buoy. The marine communication buoy includes s a round seat, side slots and hollow boxes, four side slots are uniformly distributed outside the round seat, and each side slot is connected with the hollow box in a sliding way. The marine communication buoy also includes sealing rings and buckle covers, an outer part of each hollow box is provided with a sealing ring, an outer end of each hollow box is slidably connected with the buckle cover, and an inner side of the buckle cover is in contact with the sealing ring. The marine communication buoy also includes valves and connector pipes, the connector pipe is arranged at an outer side of each buckle cover, and the connector pipe is provided with the valve.

4 Claims, 10 Drawing Sheets

(56) References Cited

U.S. PATENT DOCUMENTS

| | | | | |
|---|---|---|---|---|
| 4,896,620 | A * | 1/1990 | Jones | B63B 51/02 441/16 |
| 5,284,452 | A * | 2/1994 | Corona | B63B 22/026 441/3 |
| 5,865,656 | A | 2/1999 | Sims | |
| 6,185,988 | B1 * | 2/2001 | Baxter, Jr. | G01N 33/1886 73/866.5 |
| 6,486,786 | B2 * | 11/2002 | Chuang | B63B 22/18 340/521 |
| 6,536,277 | B1 * | 3/2003 | Chuang | G01F 23/46 340/625 |
| 9,902,469 | B2 * | 2/2018 | Knight | B63B 22/00 |
| 11,391,714 | B2 * | 7/2022 | Zhang | B63B 35/00 |
| 2004/0056779 | A1 * | 3/2004 | Rast | B63B 22/163 340/985 |
| 2011/0000417 | A1 | 1/2011 | Jone et al. | |
| 2020/0172203 | A1 | 6/2020 | Cai et al. | |

FOREIGN PATENT DOCUMENTS

| | | | |
|---|---|---|---|
| CN | 110072188 | A | 7/2019 |
| CN | 209776745 | U | 12/2019 |
| CN | 110744520 | A | 2/2020 |
| CN | 111337298 | A | 6/2020 |
| CN | 111688866 | A | 9/2020 |
| CN | 111959686 | A | 11/2020 |
| CN | 12046684 | A | 12/2020 |
| CN | 112176969 | A | 1/2021 |
| CN | 112407154 | A | 2/2021 |
| CN | 212473820 | U | 2/2021 |
| CN | 212580084 | U | 2/2021 |
| CN | 213120535 | U | 5/2021 |
| CN | 112896431 | A | 6/2021 |
| CN | 113200135 | A | 8/2021 |
| EP | 2244935 | A2 | 11/2010 |
| GB | 543124 | A | 2/1942 |
| GB | 2369327 | A | 5/2002 |
| WO | 2009106853 | A2 | 9/2009 |

OTHER PUBLICATIONS

CN-114932978-B: Sun et al., "A Circular Disc-Shaped Floating Buoy", Nov. 2022. (Year: 2022).*

CN-206182193-U: Moon, "Removing Buoy Based on Ultra-Low Frequency Signal Physaliatoxin", May 2017. (Year: 2017).*

CN-111959686-B: Cai et al., "A Storm-Resistant Buoy", May 2022. (Year: 2022).*

First Office Action issued in counterpart Chinese Patent Application No. 202110922810.2, dated May 7, 2022.

* cited by examiner

MARINE COMMUNICATION BUOY

CROSS-REFERENCE TO RELATED APPLICATIONS

This application is a continuation of International Patent Application No. PCT/CN2022/074912, filed on Jan. 29, 2022, which claims priority to Chinese Patent Application No. 202110922810.2, filed on Aug. 12, 2021. The disclosures of the aforementioned applications are hereby incorporated by reference in their entireties.

TECHNICAL FIELD

The application relates to the technical field of a buoy, and in particular to a marine communication buoy.

BACKGROUND

Chinese Patent Application Publication CN112407154A discloses a buoy system. The invention relates to a buoy system, including a buoy body and an anchoring device arranged under the buoy body for stabilizing the buoy body. The main body of the buoy includes a main cabin, an anchoring device at the bottom of the main cabin, a mast and a plurality of brackets arranged above the main cabin. The bracket surrounds the side of the main cabin. The buoy body also includes a plurality of outer wall components fixed on the brackets and outer sides of the main cabin, and the outer wall components enclose a closed floating chamber with the bracket and the side of the main cabin. The invention realizes the modularization of the structure, simplifies the production process, facilitates transportation and loading and unloading, may use small- and medium-sized fishing boats and engineering boats for launching and recycling, reduce the cost of boat operation, optimize the internal space structure of the buoy, and may install various devices in the buoy to meet monitoring requirements. However, this patent cannot improve the stability of the buoy in water when necessary.

SUMMARY

To overcome the shortcomings of the prior art, the application provides a marine communication buoy to improve the stability of the buoy in water when necessary.

The marine communication buoy includes a round seat, side slots and hollow boxes, four side slots are uniformly distributed outside the round seat, and each side slot is slidably connected with a hollow box.

Optionally, the marine communication buoy also includes sealing rings and buckle covers, the outer part of each hollow box is provided with a sealing ring, the outer end of each hollow box is connected with a buckle cover in a sliding way, and the inner side of the buckle cover is in contact with the sealing ring.

Optionally, the marine communication buoy also includes valves and connector pipes, the connector pipe is arranged at the outer side of each buckle cover, and the connector pipe is provided with a valve.

Optionally, the marine communication buoy also includes hinge seats, an upper column, a telescopic rod, hinge rods and a sliding ring. The upper side of the round seat is fixedly connected with the upper column, which is slidably connected with the sliding ring; four hinge rods are hinged on the sliding ring; each hollow box is fixedly connected with a hinge seat; the other ends of the four hinge rods are respectively hinged on the four hinge seats; the upper column is fixedly connected with the telescopic rod; and the movable end of the telescopic rod is fixedly connected with the sliding ring.

Optionally, the marine communication buoy also includes an anchor and a pull rope, the lower side of the round seat is provided with the pull rope, and the lower end of the pull rope is connected with the anchor.

Optionally, the marine communication buoy also includes an axial rib, a circular disc and a cylinder, the lower side of the round seat is fixedly connected with the cylinder, the lower part of the cylinder is provided with the circular disc, the cylinder is axially provided with the axial rib, and a compression spring is sleeved on the cylinder.

The ocean communication buoy also includes a cross, connecting rods, a collar and a connecting ring; the lower side of the cross is provided with the connecting ring, the upper part of a pull rope is tied to the connecting ring, and the upper side of the cross is provided with two connecting rods; the collar is arranged between the upper ends of the two connecting rods, and the collar is slidably connected to the cylinder and the axial rib; and the compression spring is arranged between the disc and the collar.

The marine communication buoy also includes hollow balls, and four hollow balls are arranged around the cross.

The marine communication buoy also includes a tray, and the upper part of the upper column is provided with the tray.

The marine communication buoy also includes a receiver installed on the upper side of the tray.

The marine communication buoy according to the application may improve the stability of the buoy in water when necessary.

BRIEF DESCRIPTION OF THE DRAWINGS

The present invention will be further explained in detail with reference to the attached drawings and specific embodiments.

DETAILED DESCRIPTION OF THE EMBODIMENTS

Figure 1:
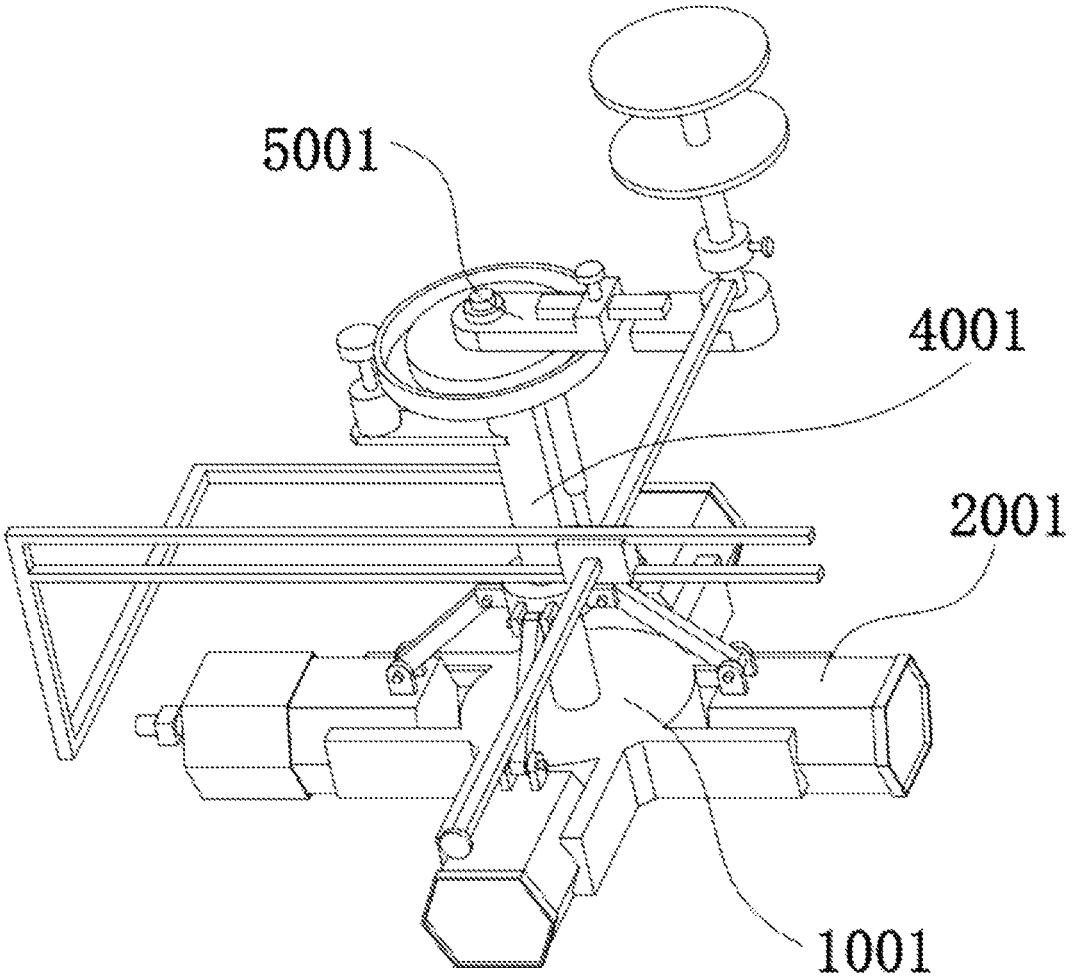
FIG. 1 is the structural diagram 1 of a marine communication buoy.
Figure 2:
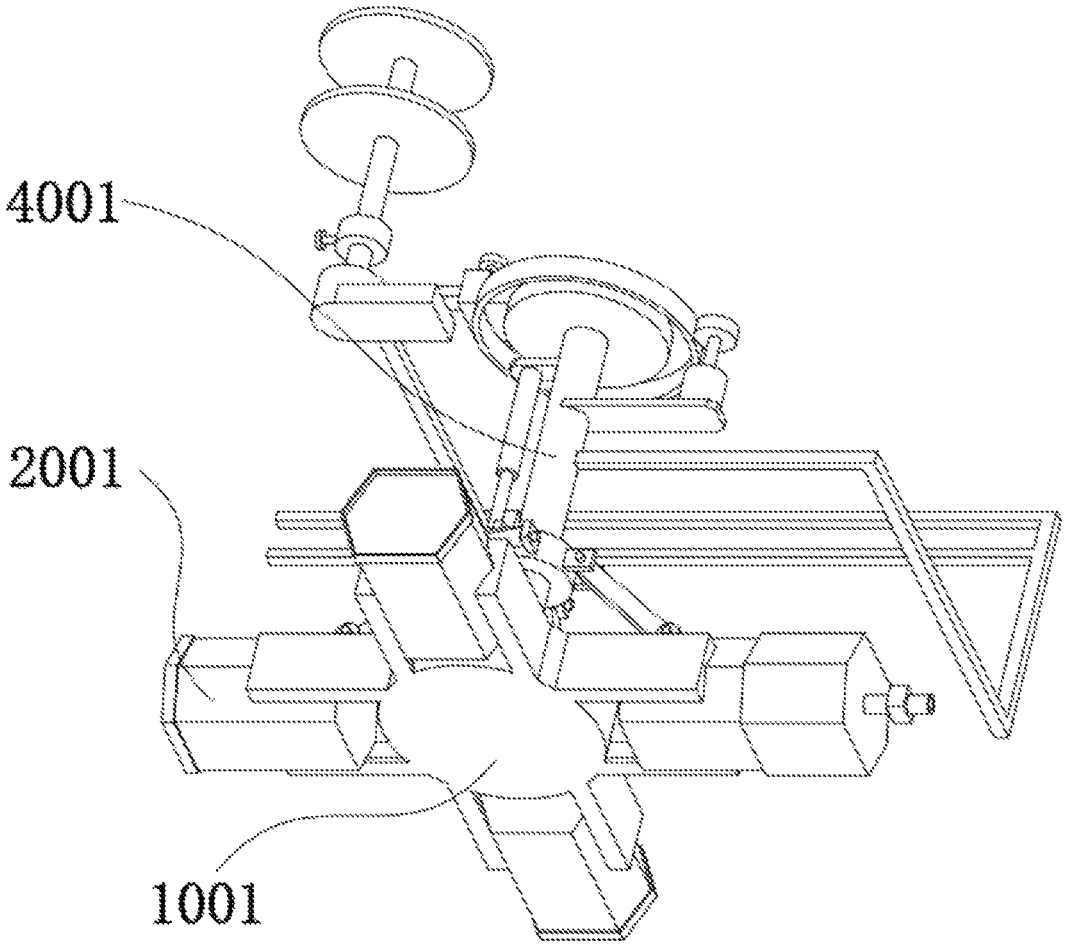
FIG. 2 is the structural diagram 2 of a marine communication buoy.
Figure 3:
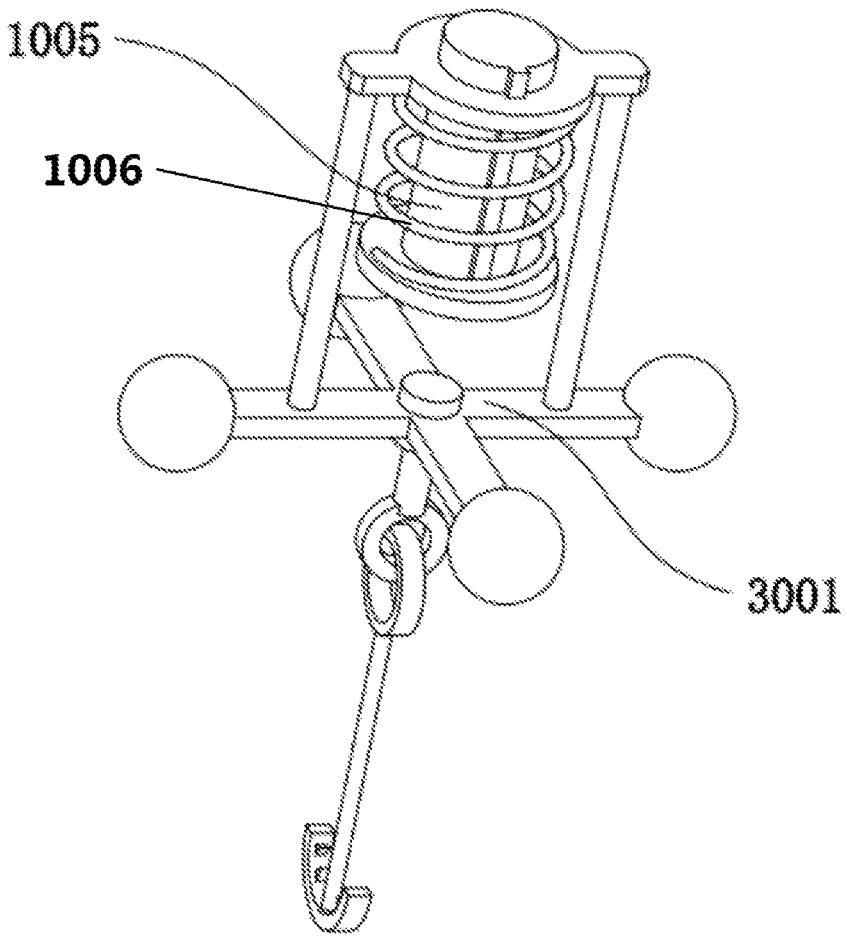
FIG. 3 is the structural diagram 3 of a marine communication buoy.
Figure 4:
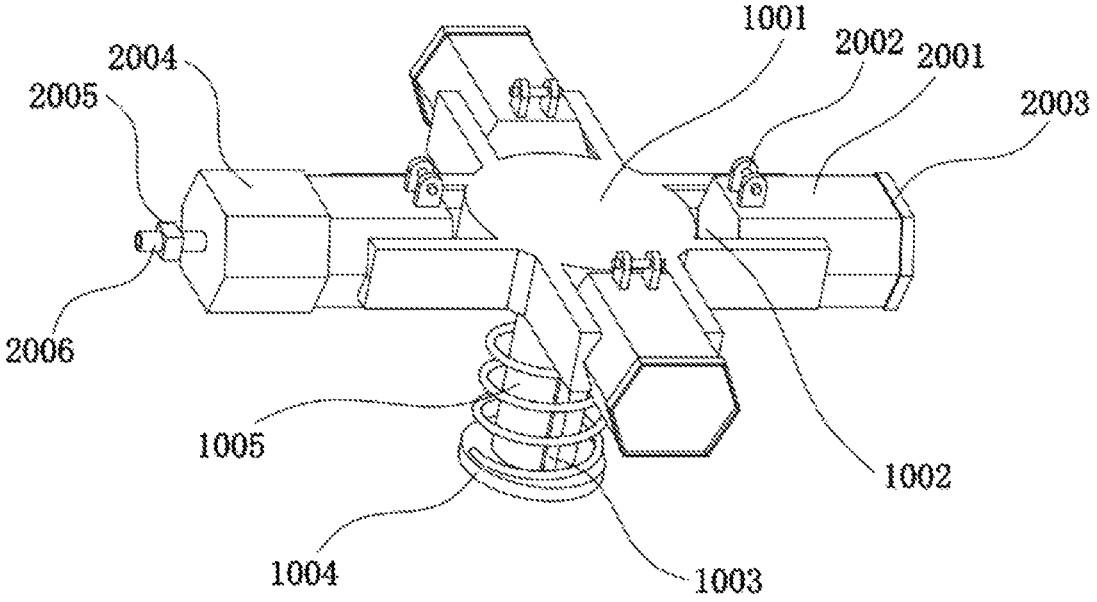
FIG. 4 is a schematic diagram of the structure of a round seat and a hollow box.
Figure 5:
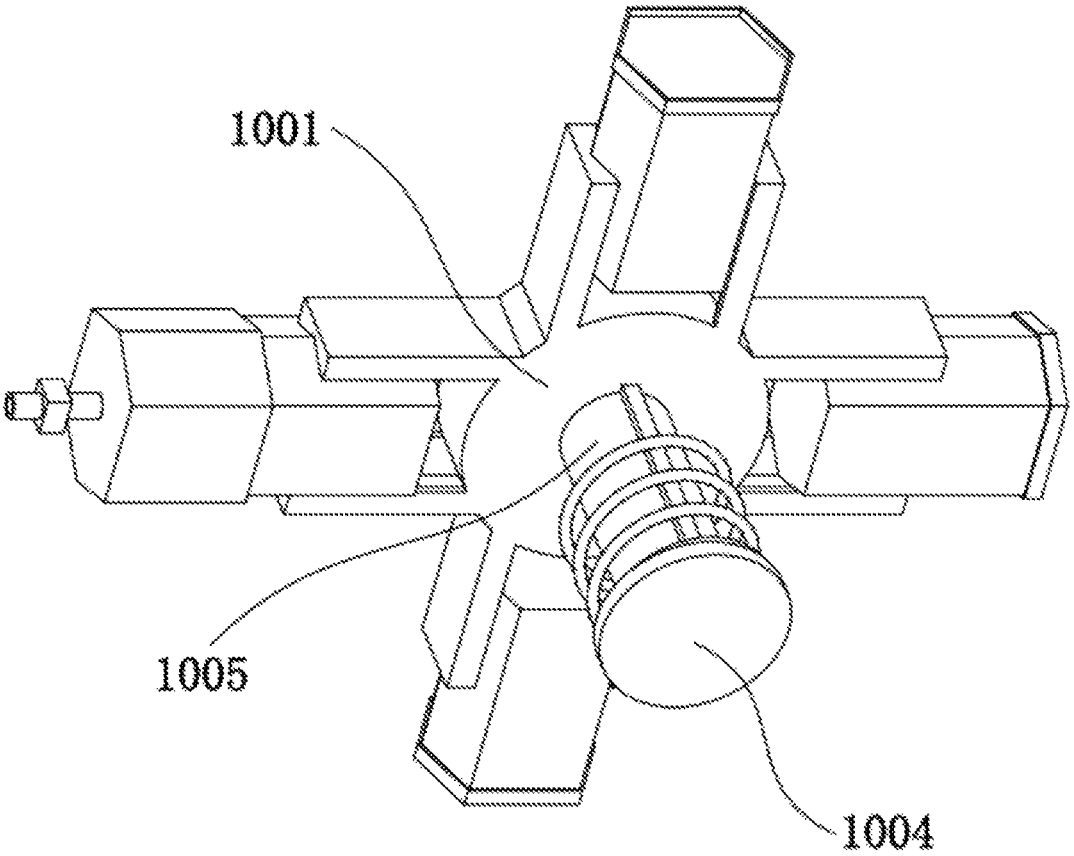
FIG. 5 is a schematic diagram of the structure of a round seat.

With reference to FIGS. 1-5, an embodiment of the present invention is provided. In this embodiment, four hollow boxes 2001 are expanded to improve the stability of the buoy in water. Furthermore, since the marine communication buoy includes a round seat 1001, side slots 1002 and hollow boxes 2001, the outer peripheral surface of the round seat 1001 is provided with four side slots 1002, and each side slot 1002 is connected with a hollow box 2001 in a slidable way, so that the four hollow boxes 2001 slide on the four side slots 1002 respectively, and expand or contract the four hollow boxes 2001. When the four hollow boxes 2001 are put into the water, the expansion of the four hollow boxes 2001 may improve the stability of the buoy in the water.

With reference to FIGS. 1-5, an embodiment of the present invention is provided. In this embodiment, the buckle covers 2004 may enlarge the volume of the hollow box 2001, so that the buoy is more stable. Furthermore, since the marine communication buoy also includes a sealing ring 2003 and buckle covers 2004, the outer part of the hollow box 2001 is connected with the sealing ring 2003, the outer end of each hollow box 2001 is connected with the buckle cover 2004 in a sliding way, and the inner side of the buckle cover 2004 is in contact with the sealing ring 2003. The sealing ring 2003 plays a role in sealing between the buckle cover 2004 and the hollow box 2001, and then the buckle cover 2004 expands the volume of the hollow box 2001, making the buoy more stable.

With reference to FIGS. 1-5, an embodiment of the present invention is provided. In this embodiment, the buckle cover 2004 is adjusted to enlarge the volume of the hollow box 2001. Furthermore, since the marine communication buoy also includes valves 2005 and connector pipes 2006, the connector pipes 2006 may inflate and deflate the buckle cover 2004, and then the buckle cover 2004 can slide left and right on the hollow box 2001 by air pressure, and thereby adjust the size of the buckle cover 2004 to adjust the volume of the hollow box 2001.

With reference to FIGS. 1-5, an embodiment of the present application is provided. In this embodiment, when the sliding ring 4004 slides on the upper column 4001, four hollow boxes 2001 are driven to slide on the side slots 1002 by four hinge rods 4003 respectively. Furthermore, the marine communication buoy also includes hinge seats 2002, an upper column 4001, a telescopic rod 4002, hinge rods 4003 and a sliding ring 4004. The upper side of the round seat 1001 is connected with the upper column 4001, which is slidably connected with the sliding ring 4004. Four hinge rods 4003 are hinged on the sliding ring 4004, and each hollow box 2001 is fixedly connected with a hinge seat 2002. The other ends of the four hinge rods 4003 are respectively hinged to the four hinge seats 2002, the upper column 4001 is provided with a telescopic rod 4002, and the telescopic end of the telescopic rod 4002 is fixedly connected to the sliding ring 4004, which can drive the sliding ring 4004 to vertically slide on the upper column 4001 when the telescopic rod 4002 is telescopic. Furthermore, when the sliding ring 4004 slides on the upper column 4001, the four hollow boxes 2001 can be driven by the four hinge rods 4003 to slide on the side slots 1002, so that the four hollow boxes 2001 expand or contract. When the four hollow boxes 2001 are put into the water, the stability of the buoy in the water may be improved after the four hollow boxes 2001 expand.

Figure 6:
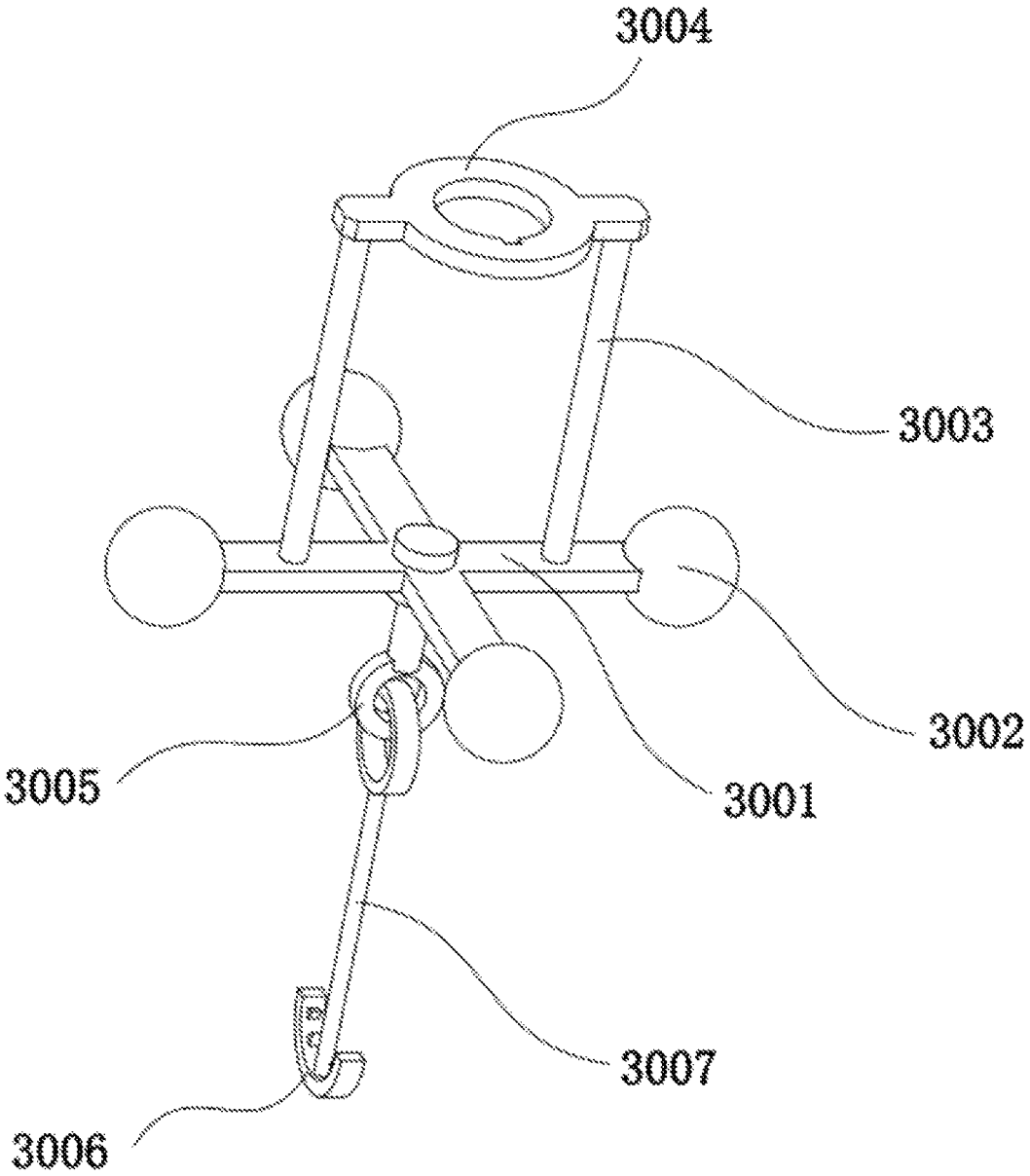
FIG. 6 is the structural diagram 1 of a cross.
Figure 7:
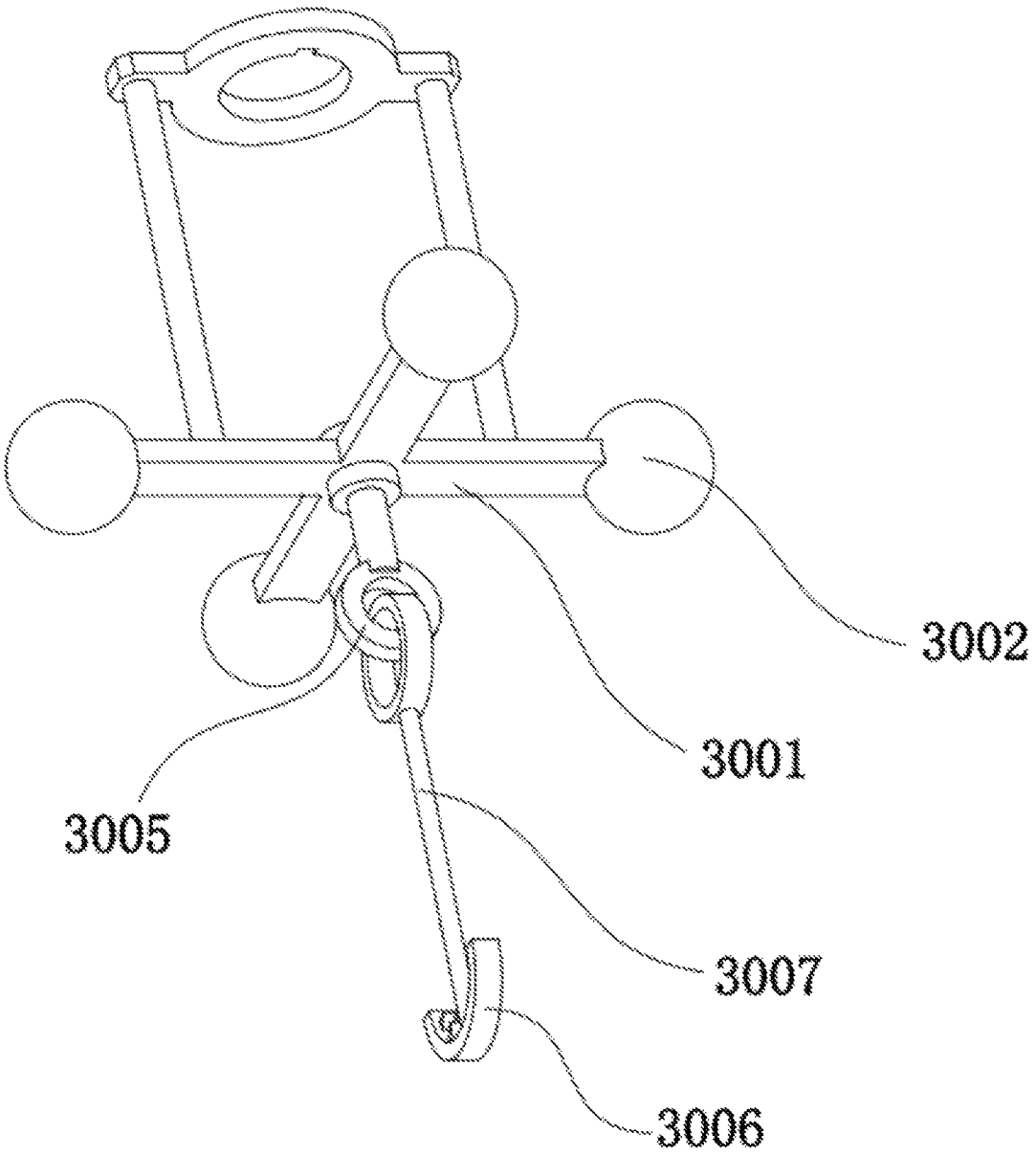
FIG. 7 is the structural diagram 2 of a cross.

With reference to FIGS. 1-7, an embodiment of the present application is provided. According to tis embodiment, the round seat 1001 and the four hollow boxes 2001 may be prevented from drifting away along the current. Furthermore, since the marine communication buoy also includes an anchor 3006 and a pull rope 3007, the lower side of the round seat 1001 is fixedly connected with the pull rope 3007, and the lower end of the pull rope 3007 is connected with the anchor 3006, which may be hooked on the bottom of the water. The anchor 3006 pulls the round seat 1001 and the four hollow boxes 2001 through the pull rope 3007, so as to prevent the round seat 1001 and the four hollow boxes 2001 from drifting away along the current.

Figure 8:
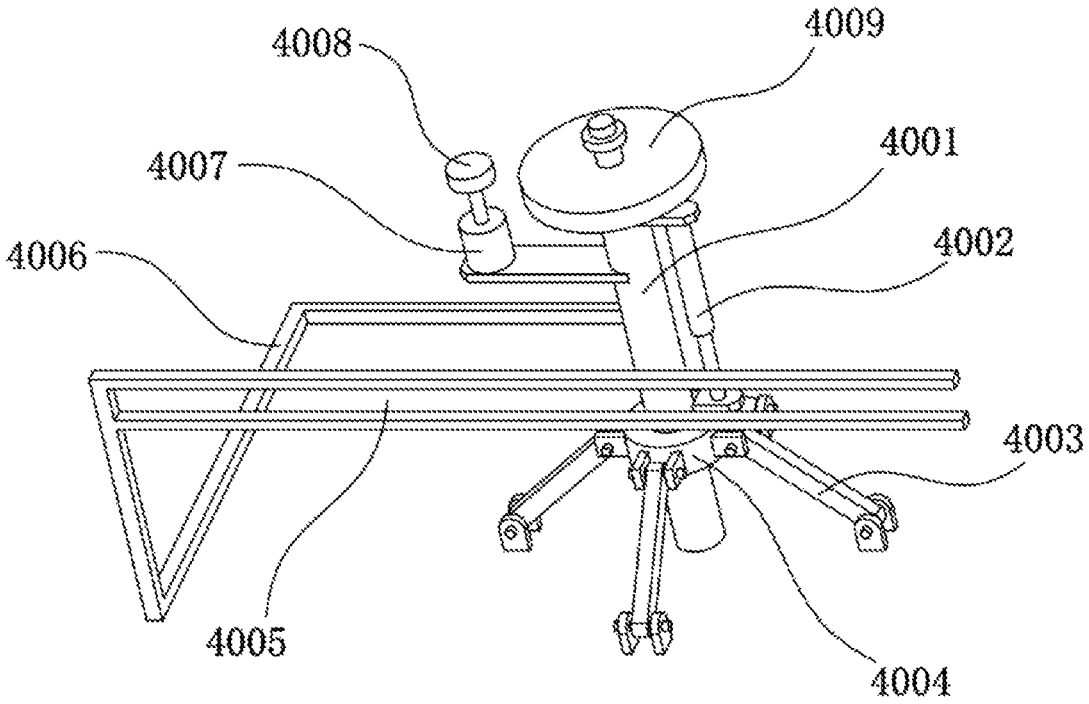
FIG. 8 is the structural diagram 1 of an upper column.
Figure 9:
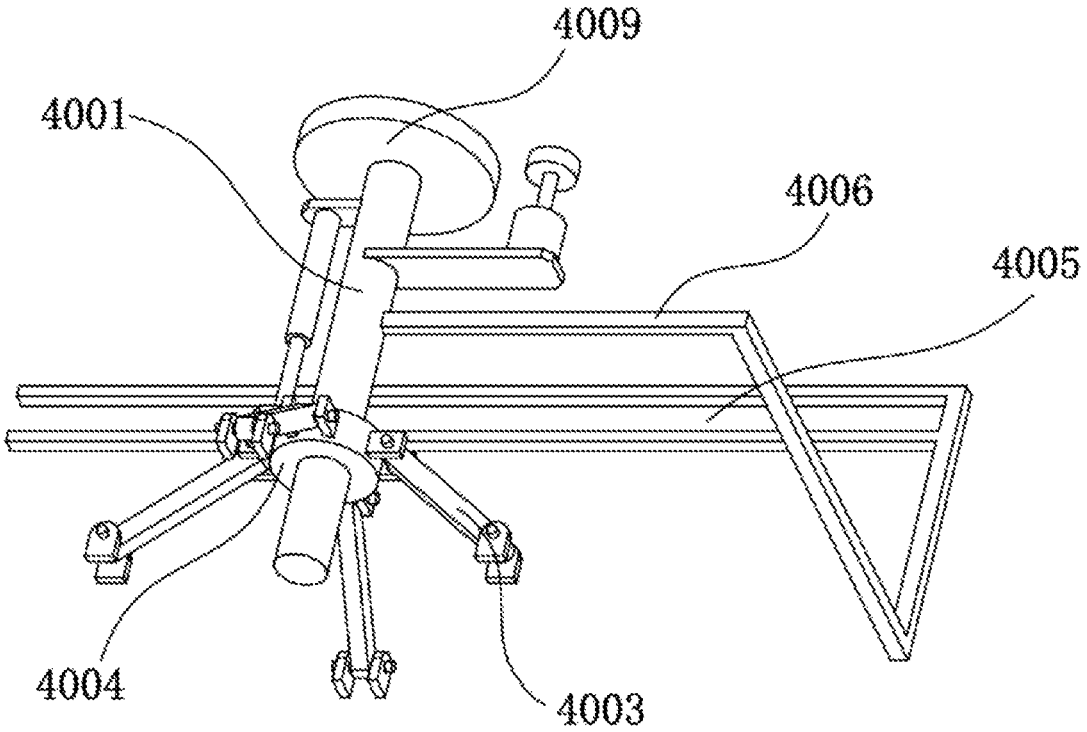
FIG. 9 is the structural diagram 2 of an upper column.
Figure 10:
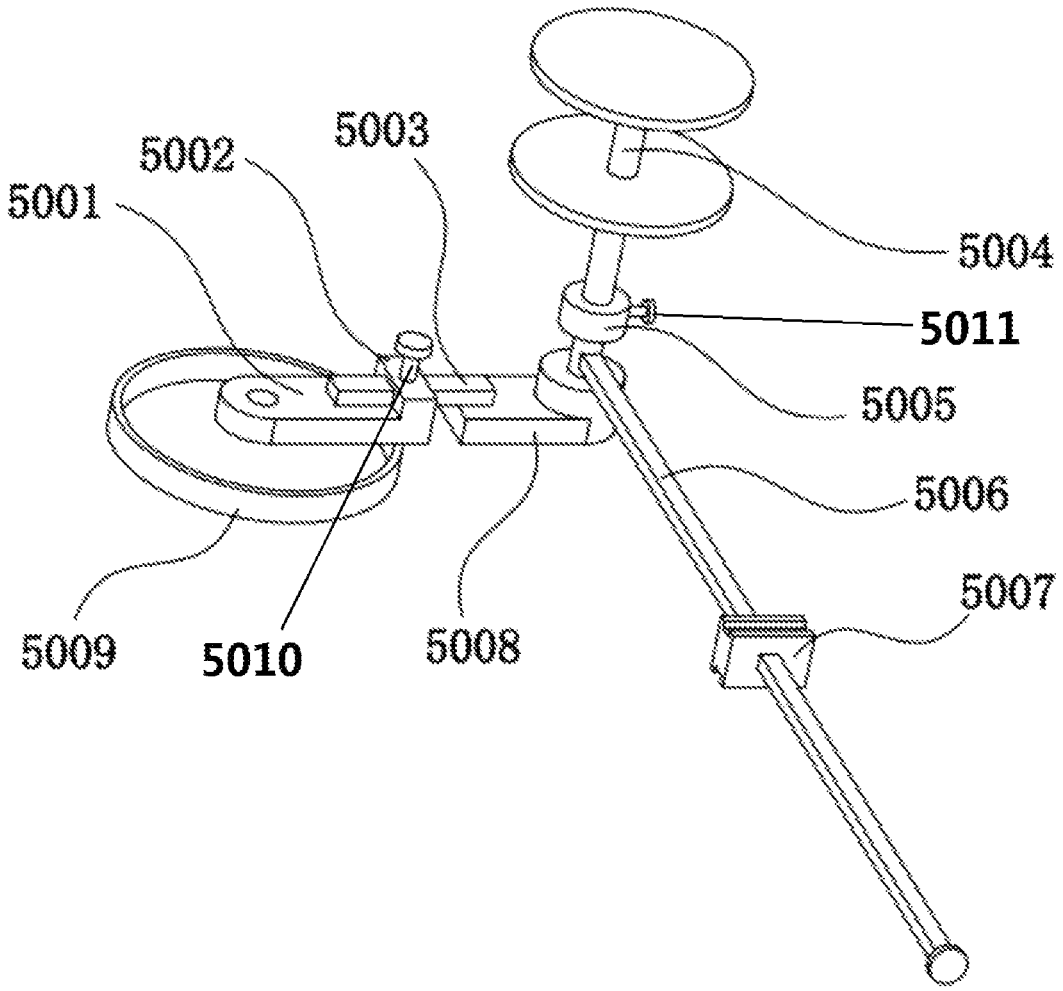
FIG. 10 is a schematic structural diagram of a turret.

With reference to FIGS. 1-10, an embodiment of the present application is provided. In this embodiment, the cylinder 1005 is used to connect the connecting ring 3005. Furthermore, the marine communication buoy also includes an axial rib 1003, a disc 1004 and a cylinder 1005, the lower side of the circular seat 1001 is provided with a cylinder 1005, the lower part of the cylinder 1005 is provided with a disc 1004, the axial rib 1003 is arranged on the cylinder 1005, and a compression spring 1006 is sleeved on the cylinder 1005 for connecting the connecting ring 3005.

With reference to FIGS. 1-10, an embodiment of the present application is provided. In this embodiment, the buoy may adapt to the height change of the water surface at different time. Furthermore, the marine communication buoy also includes a cross 3001, connecting rods 3003, a collar 3004 and a connecting ring 3005, the lower side of the cross 3001 is fixedly connected with the connecting ring 3005, the upper side of the cross 3001 is provided with two connecting rods 3003, and the collar 3004 is arranged between the upper ends of the two connecting rods 3003, and the collar 3004 is slidably connected with the cylinder 1005 and the axial rib 1003. The compression spring 1006 is located between the disc 1004 and the collar 3004. The collar 3004 vertically slides on the cylinder 1005 and the axial rib 1003. The axial rib 1003 prevents the collar 3004 from rotating relative to the cylinder 1005. The downward force of the compression spring 1006 on the disc 1004 makes the round seat 1001 and the four hollow boxes 2001 always move downward, so that the round seat 1001 always presses on the water surface.

With reference to FIGS. 1-10, an embodiment of the present application is provided. In this embodiment, the round seat 1001 and the four hollow boxes 2001 are more stable when they are placed in water. Furthermore, since the marine communication buoy also includes hollow balls 3002, four hollow balls 3002 are arranged around the cross 3001, and the four hollow balls 3002 are buoyed by water when they are in the water, so that the cross 3001 is more stable in the water, and the round seat 1001 and the four hollow boxes 2001 are more stable when they are placed in the water.

With reference to FIGS. 1-10, an embodiment of the present application is provided. In this embodiment, the tray 4009 is used for setting electronic components, and the position of the buoy is known by way of wireless communication. Furthermore, since the marine communication buoy also includes a tray 4009, the upper part of the upper column 4001 is fixedly connected with the tray 4009, and the tray 4009 is used for setting electronic components, so that the position of the buoy is known by way of wireless communication.

With reference to FIGS. 1-10, an embodiment of the present application is provided. In this embodiment, the ship acquires parameters of the buoy position when running in the water. Furthermore, the marine communication buoy also includes a receiver 5004 arranged on the upper side of the tray 4009. The receiver 5004 is used to transmit and receive signals, so that the ship acquires the parameters of the buoy position when running in the water.

The marine communication buoy also includes a motor 4007, a gear 4008, a rotating base 5001, a fixing sleeve 5002, a sliding column 5003, a half base 5008 and a toothed ring 5009. The end of the rotating base 5001 is rotatably connected to the upper side of the tray 4009, the toothed ring 5009 is fixedly connected to the rotating base 5001, the upper end of the upper column 4001 is fixedly connected with the motor 4007, the output shaft of the motor 4007 is fixedly connected with the gear 4008, which is engaged with the toothed ring 5009 for transmission; the rotating base 5001 is provided with a fixing sleeve 5002; the half base 5008 is fixedly connected with a sliding column 5003; the sliding column 5003 is slidably connected with the fixed sleeve 5002; the first fastening screw 5010 is screwed on the fixed sleeve 5002; the first fastening screw 5010 pushes against the sliding column 5003; and the lower part of the receiver 5004 is connected to the end of the half base 5008.

With reference to FIGS. 1-10, an embodiment of the present invention is provided. In this embodiment, the half base 5008 and the receiver 5004 are adjusted by taking the axis of the upper column 4001 as the radius when rotating, and different receiving modes are adjusted. Furthermore, the motor 4007 rotates to drive the gear 4008 to rotate, and then drive the toothed ring 5009 and the rotating base 5001 to rotate around the axis of the upper column 4001, and then drive the half base 5008 and the receiver 5004 to rotate around the axis of the upper column 4001, so as to continuously change the position of the receiver 5004 and obtain a larger receiving range; And the half base 5008 slides on the fixing sleeve 5002 through the sliding column 5003, thereby adjusting the distance between the receiver 5004 and the upper column 4001, further adjusting the radius of the half base 5008 and the receiver 5004 when rotating around the axis of the upper column 4001, and adjusting different receiving modes.

The marine communication buoy also includes a bearing seat 5005, the lower part of which is rotatably connected to the end of the half base 5008, and the lower end of the receiver 5004 is inserted into the half base 5008, a second fastening screw 5011 is screwed on the half base 5008, and the second fastening screw 5011 presses the lower part of the receiver 5004.

With reference to FIGS. 1-10, an embodiment of the present application is provided. In this embodiment, the orientation of the receiver 5004 is adjusted. Further, the receiver 5004 may rotate on the bearing seat 5005 to adjust the orientation of the receiver 5004, and the receiver 5004 may be fixed on the bearing seat 5005 by the second fastening screw 5011.

The marine communication buoy also includes a transverse chute 4005, a bracket 4006, a forward rod 5006 and a slider 5007. The upper part of the upper column 4001 is fixedly connected with the bracket 4006, which is transversely provided with the transverse chute 4005, and the slider 5007 is slidably connected to the transverse chute 4005. The forward rod 5006 is slidably connected to the slider 5007 in the front-rear direction, and the rear part of the forward rod 5006 is fixedly connected to the bearing seat 5005.

With reference to FIGS. 1-10, an embodiment of the present application is provided. In this embodiment, the orientation of the receiver 5004 may be kept constant when rotating around the axis of the upper column 4001. Further, when the rotating seat 5001, the half seat 5008 and the receiver 5004 rotate around the axis of the upper column 4001, the forward rod 5006 will slide back and forth relative to the slider 5007, and the slider 5007 will slide left and right on the transverse chute 4005, so that the orientation of the receiver 5004 may remain unchanged when the receiver 5004 rotates around the axis of the upper column 4001.

What is claimed is:

1. A marine communication buoy, comprising a round seat, side slots and hollow boxes, wherein four side slots are uniformly distributed outside the round seat, and each of the side slots is slidably connected with each hollow box;

the marine communication buoy further comprises sealing rings and buckle covers, an outer part of each hollow box is provided with the sealing ring, an outer end of each hollow box is connected with the buckle cover in a sliding way, and an inner side of the buckle cover contacts with the sealing ring;

the marine communication buoy further comprises valves and connector pipes, the connector pipes are arranged at outer sides of buckle covers, and the connector pipes are provided with the valves;

the marine communication buoy further comprises hinge seats, an upper column, a telescopic rod, hinge rods and a sliding ring, an upper side of the round seat is fixedly connected with the upper column slidably connected with the sliding ring; the four hinge rods are hinged on the sliding ring; four hollow boxes are fixedly connected with four hinge seats respectively; the other ends of the four hinge rods are respectively hinged on the four hinge seats; the upper column is fixedly connected with the telescopic rod; and a movable end of the telescopic rod is fixedly connected with the sliding ring;

the marine communication buoy further comprises an anchor and a pull rope, a lower side of the round seat is provided with the pull rope, and a lower end of the pull rope is connected with the anchor;

the marine communication buoy further comprises an axial rib, a circular disc and a cylinder, the lower side of the round seat is fixedly connected with the cylinder, a lower part of the cylinder is provided with the circular disc, the cylinder is axially provided with the axial rib, and a compression spring is sleeved on the cylinder; and the ocean communication buoy further comprises a cross, connecting rods, a collar and a connecting ring, a lower side of the cross is provided with the connecting ring, an upper part of the pull rope is tied to the connecting ring, and an upper side of the cross is provided with two connecting rods; the collar is arranged between upper ends of the two connecting rods, and the collar is slidably connected to the cylinder and the axial rib; and the compression spring is arranged between the disc and the collar.

2. The marine communication buoy according to claim 1, wherein the marine communication buoy further comprises hollow balls, and four of the hollow balls are arranged around the cross.

3. The marine communication buoy according to claim 2, wherein the marine communication buoy further comprises a tray, and an upper part of the upper column is provided with the tray.

4. The marine communication buoy according to claim 3, wherein the marine communication buoy further comprises a receiver, and the receiver is installed on an upper side of the tray.

* * * * *